US005977033A

United States Patent [19]

Lefebvre et al.

[11] Patent Number: 5,977,033

[45] Date of Patent: Nov. 2, 1999

[54] LUBRICATED ALUMINUM POWDER AGGLOMERATES HAVING IMPROVED FLOWABILITY

[75] Inventors: Louis-Philippe Lefebvre; Yannig Thomas, both of Montreal; Sylvain Pelletier, Ste-Julie, all of Canada

[73] Assignee: National Research Council of Canada, Ottawa, Canada

[21] Appl. No.: 09/129,642

[22] Filed: Aug. 5, 1998

[51] Int. Cl.[6] ..... C10M 103/04; C10M 111/04

[52] U.S. Cl. ..... 508/551; 508/555; 508/591; 508/165; 508/172; 75/231; 75/244; 419/23; 419/36; 419/37; 419/38; 419/64; 419/66

[58] Field of Search ..... 508/551, 555, 508/591, 165, 172; 75/231, 244; 419/23, 36, 37, 38, 64, 66

[56] References Cited

U.S. PATENT DOCUMENTS

| | | | |
|---|---|---|---|
| 4,955,798 | 9/1990 | Musella et al. | 75/231 |
| 5,594,186 | 1/1997 | Krause et al. | 419/23 |
| 5,624,631 | 4/1997 | Luk | 419/23 |
| 5,744,433 | 4/1998 | Storström et al. | 75/231 |

*Primary Examiner*—Jerry D. Johnson
*Attorney, Agent, or Firm*—Juliusz Szereszewski

[57] ABSTRACT

The present invention relates to particle agglomeration of aluminum powder using a lubricating binder. The resulting powder has improved flowability and can be shaped easily. The aluminum particles are admixed with a lubricant, e.g. polyethylene, and are held together by the lubricant. To agglomerate the aluminum powder, the lubricant is melted and is then solidified to form solid bridges between the aluminum powder particles. The lubricant may be burned out cleanly at temperatures lower than 450° C.

13 Claims, 1 Drawing Sheet

LUBRICATED ALUMINUM POWDER AGGLOMERATES HAVING IMPROVED FLOWABILITY

FIELD OF THE INVENTION

This invention relates to agglomeration of aluminum powders, and specifically, to a process for agglomerating aluminum powder particles using a selected lubricant. The invention also relates to aluminum powder agglomerates produced by the process.

BACKGROUND OF THE INVENTION

Powder metallurgy (P/M) is a well-established process for the fabrication of near-net- shape components. In press and sinter applications for example, the powder is compacted in a die to form a green compact. The compact is then ejected from the die and sintered to create metallurgical bonds between the particles. For the compaction of the powder, a lubricant is generally required to improve the compressibility of metal powders and also to reduce the powder/die wall friction in order to facilitate part ejection and minimize die wear.

Processing of powders strongly depends on powder flowability. Powder flowability is defined as the time required for a specific quantity of powder to flow through an orifice or a die cavity. Flowability of a powder is important in high-volume manufacturing, which depends on rapid, uniform, consistent filling of die cavity. Poor flow characteristics cause slow and nonuniform press feeding and difficulty in ensuring a fill of the die cavity. Free-flowing powder refers to powders that readily flow in the die cavity [ASM Handbook, vol. 7: Powder Metallurgy].

It is well known that aluminum powders do not have good flowability, partly because of their low density. This is particularly critical when small particles, especially particles smaller than 50 $\mu$m, are used. Flowability of the powder may be improved by using spherical powders. However, the flowability of spherical powder is in some case not sufficient for effective processing of the powder.

Particle agglomeration, also known as granulation and particle size enlargement, has been used for a long time to improve the flowability of powders. It is used for example in the fertilizer, pharmaceutical, food and mining industries. Different methods exist to form particle agglomerates. Some of them use a binder to agglomerate the particles.

The properties of aluminum P/M materials are highly sensitive to the presence of non- metallic additives in the starting powder. For that reason, the choice of an adequate binder that does not affect the properties of the final product is critical for aluminum P/M applications. The binder should burn out cleanly at temperature typically lower than 450° C. to avoid the reaction of the decomposition products or residual products with the aluminum matrix. In addition, the binder content should be kept as low as possible to minimize the deleterious effect of the binder on the final properties of the material. On the other hand, the binder content must be sufficient to allow the formation of particle agglomerates. If the binder content is not sufficient, it is difficult to form agglomerates and the mechanical properties of the agglomerates are not sufficient for handling and shipping.

For the compaction of powder by P/M techniques, a lubricant is also generally required to ease the compaction of the powder and the ejection of the fabricated parts. The requirements for the lubricant are similar to those for the binder. The lubricant should not affect the final properties of the material.

Synthetic amide waxes, like ethylene-bis-stearamide wax, are frequently used as lubricants for aluminum press and sinter applications. A recent work of the instant inventors revealed that polyethylene wax may also be used for the compaction of aluminum powder compacts. As it is the case for the binder, the amount of lubricant should be minimized to optimize the properties of the final component. On the other hand, the lubricant should be sufficient to provide adequate lubrication during compaction and ejection.

SUMMARY OF THE INVENTION

It is an object of this invention to provide powder compositions having improved flowability for the fabrication of aluminum-based powder compacts.

It is another object of the invention to provide agglomerated aluminum compositions suitable for powder metallurgy applications.

According to one aspect of the invention, there is provided a metallurgical powder composition comprising an aluminum-based metallic powder and from about 0.1 to about 3 wt. % of an aluminum-compatible lubricant based on the total weight of the composition, preferably from about 0.2 wt. % to about 1.5 wt. %. The composition contains typically at least 50 wt. % of the metallic powder, wherein at least 50 wt. % of the metallic powder is elemental aluminum (Al). For instance, the composition may comprise Al powder and/or an aluminum-alloy powder. The composition may comprise aluminum alloys and aluminum compatible alloying elements as well as reinforcing components.

The composition consists of distinct, flowable agglomerates. The particle size distribution of the agglomerates (granules) is from about 10 micrometers to about 5 mm, but preferably from about 45 micrometers to about 1 mm.

According to another aspect of the invention, there is provided a process for producing an aluminum-based agglomerated powder composition, the process comprising a) preparing a composition containing predominantly an aluminum-based metallic powder and an aluminum-compatible lubricant in an amount from about 0.1 wt. % to about 3 wt. % of the composition distributed throughout said mixture,
b) heating the said composition to melt the lubricant,
c) cooling the said powder composition to solidify completely or partially the lubricant and
d) forming aluminum based powder agglomerates from said composition of step c).

Preferably, the temperature in step b) should not exceed about 300° C. The amount of the admixed lubricant is preferably from about 0.2 wt. % to about 1.5 wt. % based on the weight of the composition.

The term "aluminum-compatible lubricant" denotes a lubricant that can be burned out from a mixture with aluminum-based powder without leaving a substantial amount of residue at a temperature below about 450° C. In addition, the lubricant should melt at temperature lower than about 300° C. to bind the metallic powder particles together.

BRIEF DESCRIPTION OF THE DRAWINGS

The invention will be explained in more detail by way of the following disclosure to be taken in conjunction with the drawing in which.

DETAILED DESCRIPTION OF THE INVENTION

Figure 1:
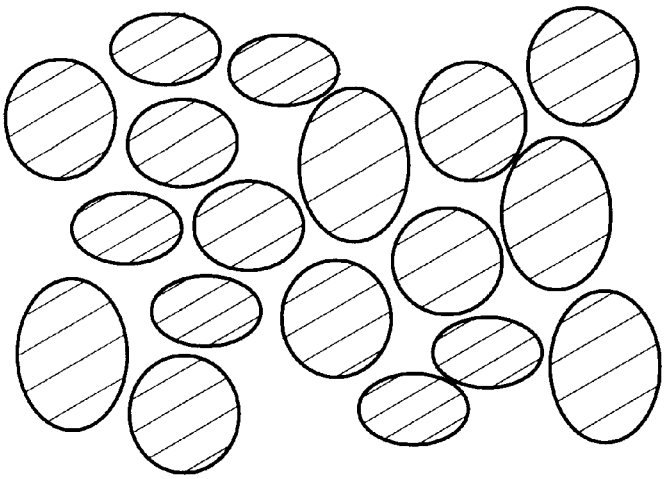
FIG. 1*a* illustrates the starting material, an aluminum powder.
FIG. 1*b* illustrates a single agglomerate.
Figure 2:
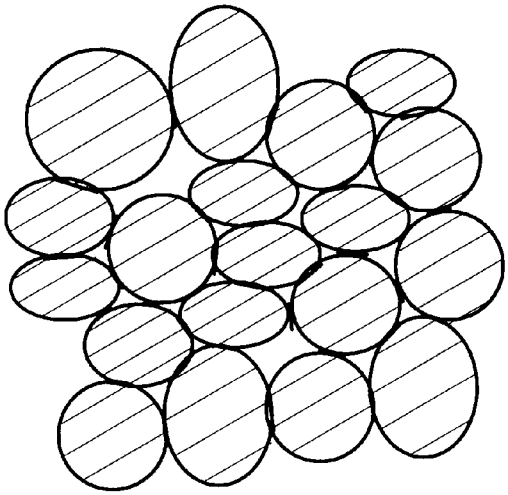

The aluminum powder compositions of the invention have improved flowability. The compositions comprise aluminum based powders i.e. aluminum powder or aluminum-alloy powder, and a lubricating binder. The compositions are prepared in such a way as to form powder agglomerates having a coarser (larger) particle size than the starting powders. The agglomerate particles are held together by the lubricant. To agglomerate the aluminum powder, the lubricant is melted and is then solidified to form solid bridges 10 between the aluminum powder particles 12 as shown in FIG. 1*b*. The resulting product is a free-flowing aluminum powder composition that can be shaped easily.

The powder compositions are suitable for the fabrication of aluminum compacts for P/M applications. The metallic content of the composition is higher than 50 wt. % of the entire composition before delubrication. The metallic content is composed of aluminum powders, aluminum alloys and alloying elements (compatible with aluminum), all commonly known in metallurgy. The bulk composition of the metallic phase contains typically more than 50 wt. % aluminum (Al), thus the elemental content of aluminum in the composition is at least 25 wt. % based on the weight of the composition. The particle size distribution of the metallic powders is typically larger than 1 $\mu$m and less than 1000 $\mu$m, preferably between 10 $\mu$m and 250 $\mu$m. Additives such as standard reinforcements (SiC, $Al_2O_3$, fly ash etc.) may be admixed in the composition.

The powder compositions contain an aluminum-compatible lubricant that can be burned out without leaving a substantial amount of residue at a temperature below about 450° C. In addition, the lubricant should melt at temperature lower than about 300° C. to bind the metallic powder particles together. Typically, a polyethylene wax or a synthetic amide wax, may be used as a lubricant.

The lubricant may be admixed to the metallic powders in the solid state, in melted state, in solution or emulsion. When the lubricant is admixed to the powder in solution or emulsion, the solvent must be removed using vacuum or heat. The lubricant content is typically between about 0.1 wt. % and about 2.5 wt. % but preferably between 0.2 and 1.5 wt. % based on the total weight of the composition.

The powder composition is heated to melt the lubricant. Once the lubricant is melted and uniformly distributed in the composition, the powder composition is cooled down to form solid lubricant bridges between the metallic particles. The resulting product is agglomerated powder wherein several powder particles form a granule. The agglomerate particle size distribution depends on the starting powders, the type and amount of admixed lubricant and on the processing conditions. The granulometry of the powders may be adjusted to fill the requirements of the specific application. The agglomerate granule size may range from about 10 microns up to about 5 millimetres, but preferably between 45 $\mu$m and 1 mm.

The agglomeration may be effected using known agglomeration techniques and equipment such as drum granulators, inclined dish granulators, mixers, fluidized bed granulators, spouted bed granulators, vibratory granulators, rotary and gyratory granulators. The agglomeration may also be carried out using compaction and extrusion.

The agglomerated powder compositions of the invention can be compacted using conventional powder metallurgy conditions. The compacting pressures are typically lower than 800 MPa and more specifically between 100 and 700 MPa. The powder compositions may be compacted using die wall lubrication.

Delubrication of Al powder compact can be achieved in inert atmosphere at a temperature lower than 450° C. The delubrication is achieved in an inert atmosphere at a temperature from 400° C. up to 450° C. depending on the delubrication atmosphere, material, part size and geometry. The duration of delubrication may vary from 10 minutes up to 2 hours, and more specifically between 20 minutes and 90 minutes. After delubrication, the specimens are subjected to final consolidation steps like sintering, rolling, extrusion, forging, coining or other techniques known in powder metallurgy.

EXAMPLE

The following example presents the advantage of the powder compositions of the invention. Properties of Al powders agglomerated with polyethylene (PE: Acumist B-12, Allied Signal Inc.) and synthetic amide wax (Promold 450: Morton International) were compared to properties of unagglomerated powders. The powder was dry blended in a "V" type blender for 30 min (26 rpm) with 1.0 wt. % lubricant. The mixes were prepared with pre-alloyed Al-6061 aluminum powder provided by Valimet Inc. This aluminum powder is a gas-atomized and spherical powder whose composition is 0.25% Cu, 0.9% Mg, 0.6% Si, 0.07% Cr, 0.24% Fe, 0.04% Mn, 0.02% Ti, 0.01% Zn, balance Al, and its particle size distribution is lower than 170 US mesh.

The composition containing PE was prepared by heating the composition at 160° C., cooling the composition under a low pressure (a few lb./sq. in) to form a cake, and breaking the cake to form the agglomerated particles. The composition fabricated with the synthetic amide wax was prepared using the same procedure with the exception that the heating temperature was 250° C.

Table 1 presents the flowing characteristics of unagglomerated powder, PE agglomerated powder and powder agglomerated with the synthetic amide wax. The flow tests were done using a Carney flowmeter. The values given in Table 1 represent the time required for a 20 g powder sample to flow through the funnel under atmospheric conditions. The values are the average of 5 tests.

TABLE 1

Time required for 20 g of the different powder to flow in a Carney flowmeter

| Powder | Carney flow rate (20 g) |
|---|---|
| As received | does not flow |
| Agglomerated (PE) | 9.32 |
| Agglomerated (synthetic amide wax) | 9.41 |

It will be seen from the drawing that the particles of the starting powder (FIG. 1*a*) are separate (loose), while the particles of the agglomerated powder (FIG. 1*b*) form tightly-packed granules, with individual powder particles 12 bound by lubricant bridges 10.

We claim:

1. A metallurgical powder composition comprising an aluminum- based metallic powder and from about 0.1 to about 3 wt. % aluminum-compatible lubricant based on the total weight of the composition, the composition consisting of distinct, separate agglomerates formed from said powder and said lubricant and having size distribution from about 10 micrometers to about 5 mm.

2. The composition of claim 1 wherein the size distribution is from about 45 micrometers to about 1 mm.

3. The composition of claim 1 which comprises at least 50 wt. % of the metallic powder, wherein the metallic powder contains at least 50 wt. % aluminum.

4. The composition of claim 1 wherein the content of the lubricant is from about 0.2 wt. % to about 1.5 wt. %.

5. The composition of claim 1 wherein the lubricant is polyethylene.

6. The composition of claim 1 wherein the lubricant is a synthetic amide wax.

7. A process for producing an aluminum agglomerated powder composition, the process comprising a) preparing a composition containing predominantly an aluminum-based metallic powder and an aluminum-compatible lubricant in an amount from about 0.1 wt. % to about 3 wt. % of the composition distributed throughout said composition, b) heating said composition to melt the lubricant, c) cooling said powder composition to solidify completely or partially the lubricant and d) forming distinct aluminum based powder agglomerates from the composition of step c).

8. The process of claim 7 wherein the agglomerates have a size distribution from about 10 micrometers to about 5 mm.

9. The process of claim 7 wherein the size distribution is from about about 45 micrometers to about 1 mm.

10. The process of claim 7 wherein said lubricant is polyethylene.

11. The process of claim 7 wherein said lubricant is a synthetic amide wax.

12. The process of claim 7 wherein the content of the lubricant is from about 0.2 wt. % to about 1.5 wt. %.

13. The process of claim 7 wherein the heating temperature in step b) is lower than about 300° C.

* * * * *